US007556403B2

(12) United States Patent
Stadjuhar, Jr.

(10) Patent No.: US 7,556,403 B2
(45) Date of Patent: Jul. 7, 2009

(54) HOODED FACE PLATE FOR A MESSAGE AND DISPLAY SIGN

(75) Inventor: Robert Charles Stadjuhar, Jr., Colorado Springs, CO (US)

(73) Assignee: Skyline Products, Inc., Colorado Springs, CO (US)

( * ) Notice: Subject to any disclaimer, the term of this patent is extended or adjusted under 35 U.S.C. 154(b) by 477 days.

(21) Appl. No.: 11/273,826

(22) Filed: Nov. 15, 2005

(65) Prior Publication Data

US 2007/0107281 A1 May 17, 2007

(51) Int. Cl.
*F21V 11/02* (2006.01)

(52) U.S. Cl. ..... 362/290; 362/291; 362/812; 362/249.02; 40/579

(58) Field of Classification Search ..... 362/237, 362/248, 290, 291, 321, 354, 812, 249.02, 362/800; 40/541, 550, 564, 579
See application file for complete search history.

(56) References Cited

U.S. PATENT DOCUMENTS

| | | | | |
|---|---|---|---|---|
| 4,843,527 | A * | 6/1989 | Britt | 362/231 |
| 5,321,417 | A * | 6/1994 | Voelzke et al. | 345/32 |
| 5,390,092 | A * | 2/1995 | Lin | 362/235 |
| 5,685,634 | A * | 11/1997 | Mulligan | 362/237 |
| 5,882,105 | A * | 3/1999 | Barlow | 362/646 |
| 6,677,922 | B1 * | 1/2004 | Johnson et al. | 345/84 |
| 7,131,226 | B2 * | 11/2006 | Gray et al. | 40/452 |
| 7,284,881 | B2 * | 10/2007 | Kim et al. | 362/290 |

* cited by examiner

*Primary Examiner*—Thomas M Sember
(74) *Attorney, Agent, or Firm*—Dale B. Halling

(57) ABSTRACT

A display and messaging sign includes a number of pixels and a hooded face plate. The hooded face plate includes a number of hooded apertures, with a hood over each of the pixels. Each pixel is aligned with an aperture.

18 Claims, 3 Drawing Sheets

HOODED FACE PLATE FOR A MESSAGE AND DISPLAY SIGN

PRIORITY DATA

None

FIELD OF THE INVENTION

This invention relates generally to the field of display signs using illuminating elements to display a message, and more specifically to a face plate with hoods over the illuminating elements.

BACKGROUND OF THE INVENTION

Display signs are found virtually everywhere. They provide important information to our society, particularly regarding commerce and travel. Static signs provide a medium for displaying a message, but cannot be changed without a significant effort and expense. A solution for this shortcoming is a display sign that is easy to change. Typically, these signs have a plurality of illuminant elements in a matrix that can be selectively illuminated to create an image or a message. However, these signs have some shortcomings.

The first shortcoming is that ambient light, such as direct sunlight, may make all or some of the illuminating elements in the matrix appear illuminated even when they are not. In addition, direct sunlight on the pixels (illuminating elements) will significantly degrade the contrast between the pixels. Large, one-piece hoods or visors have been incorporated across entire matrices to address this problem, but these visors create more problems, such as excess weight and additional materials and costs.

A second shortcoming is that the exposed illuminating elements may collect water, ice and dirt, particularly on their tops. Sign manufacturers have incorporated glazing over the entire matrix to keep the elements out, but again, more problems are created, such as glare from the large flat piece of glass or other material. In addition, the weight and cost penalty for glazing is very large.

Thus, what is needed is a display sign with a plurality of illuminating elements that provides contrast enhancement by minimizing or eliminating the problems of direct sunlight upon the illuminating elements and protects the illuminating elements from the water and dirt without heavy glazing.

It is intended that any other advantages and objects of the present invention that become apparent or obvious from the detailed description or illustrations contained herein are within the scope of the present invention.

SUMMARY OF THE INVENTION

A display and messaging sign includes a plurality of light-emitting elements, such as light bulbs, LEDs, or groups of LEDs that may form a pixel; and a hooded face plate near the pixels. The hooded face plate includes a number of hooded apertures, with a hood over each of the light emitting elements or pixels. Each pixel may enter an aperture and may be even with, or extend beyond, an outer surface of the face plate. Each hood may be curved over its light emitting element.

The hoods are designed so that each pixel obtains the most protection from direct sunlight and still provides the field of view necessary for the sign's application. As a result, the greatest contrast enhancement for direct sunlight is obtained. The hooded face place is inexpensive to manufacture and costs no more than punching holes in the face plate for each pixel.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

Figure 1:
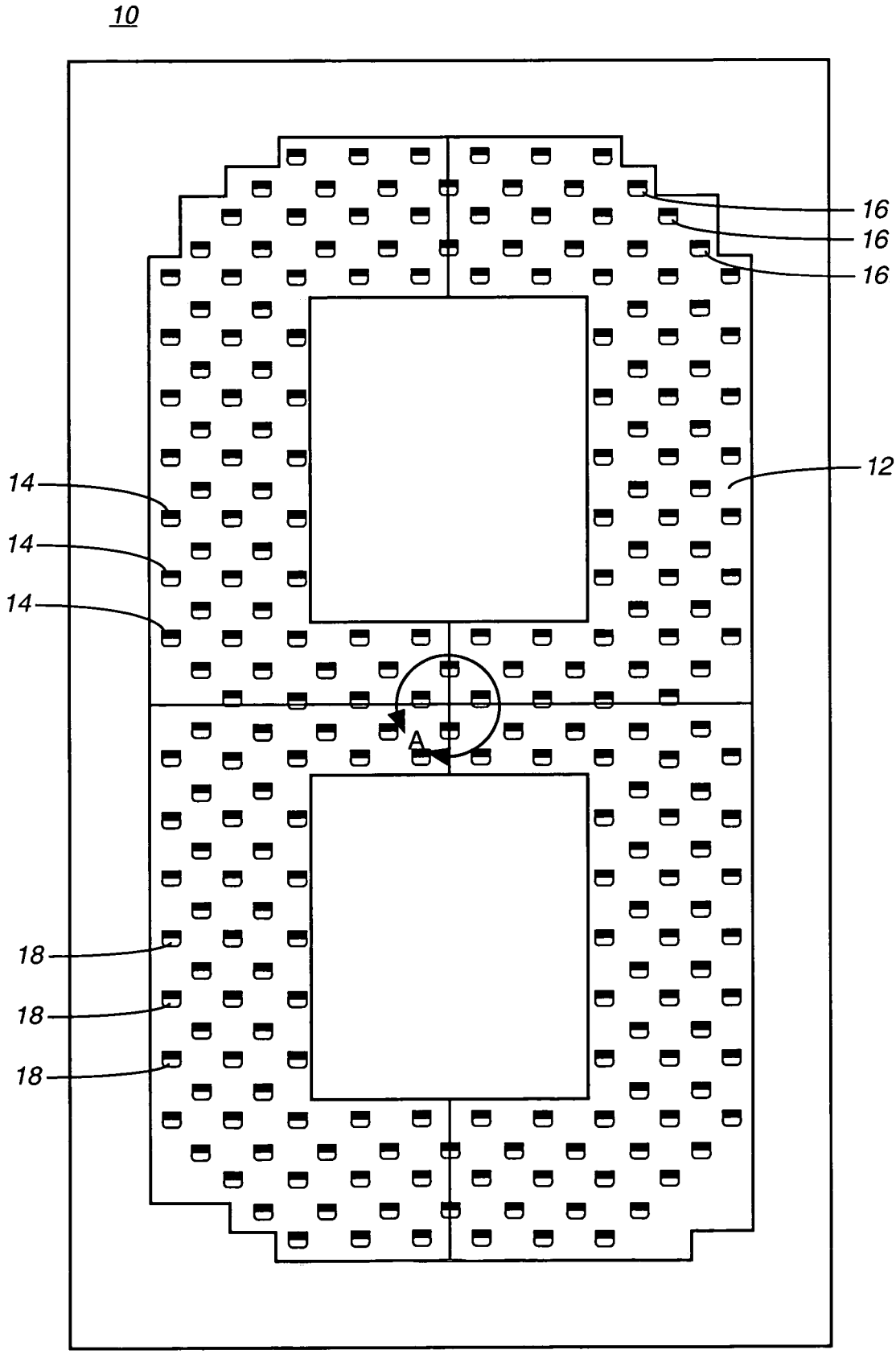
FIG. 1 is a front view of a display and messaging sign, according to the present invention.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DETAILED DESCRIPTION OF THE INVENTION

Referring now to the drawings, the attached figures illustrate a hooded face plate for a message and display sign. The hooded face plate has a hood for each pixel of light. A pixel may include more than one LED or other light source. The hoods may be punched into a sheet of metal. As a result, the hooded face plate has the same manufacturing costs as a face plate with holes for each pixel. The hood is designed to provide the most protection from direct sunlight as possible and still allow the pixels to be seen from all necessary angles. This provides the greatest contract enhancement for the sign in direct sunlight.

FIG. 1 is a front view of a display and messaging sign 10, according to the present invention. The hooded face plate 12 includes a plurality of apertures 16. A hood 14 is found above each aperture 16. A single pixel of light, such as a light bulb(s) or LED(s), is inside each aperture 16 so that it light is easily seen to viewers in front of the sign 10. The layout of the apertures 16 and LEDs 18 is a figure-8 pattern in this embodiment, which permits a user to create most common letters, symbols and numbers. Other layouts are easily possible. Such a sign is highly appropriate for announcing traffic and road conditions, special events, or commercial activities.

Figure 2:
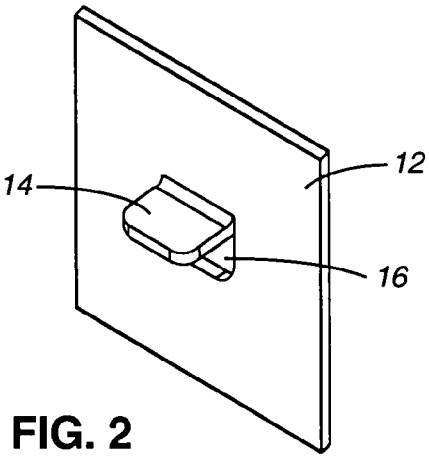
FIG. 2 is a perspective view of a single hooded aperture for the display and messaging sign, according to the present invention.

FIG. 2. is a perspective view of a single hooded aperture 16 for the display and messaging sign 10, according to the present invention. The face plate 12 is a single sheet of material, such as sheet aluminum. However, other materials with similar properties can be used.

Figure 3:
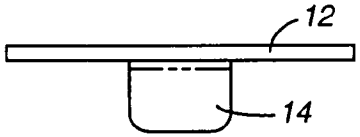
FIG. 3 is a top view of a single hooded aperture for the display and messaging sign, according to the present invention.
Figure 4:
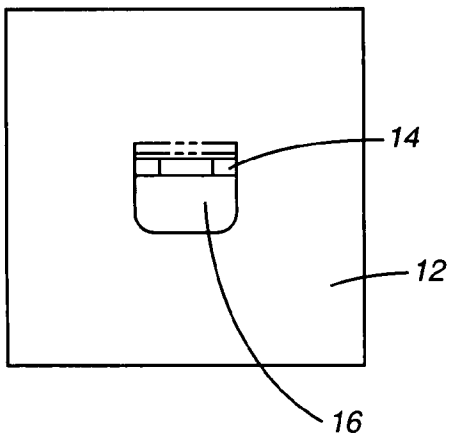
FIG. 4 is a front view of a single hooded aperture for the display and messaging sign, according to the present invention.

FIGS. 3 and 4 are top and front views of a single hooded aperture for the display and messaging sign, according to the present invention. The hood 14 is a simple shape with rounded corners. The hood 14 is easily formed via a punch machine. As a result, it costs no more to manufacture than a face plate with holes for each pixel.

Figure 5:
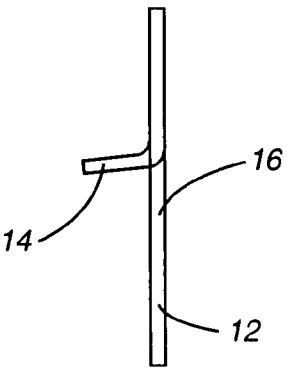
FIG. 5 is a side view of a single hooded aperture for the display and messaging sign, according to the present invention.

FIG. 5 is a side view of a single hooded aperture for the display and messaging sign, according to the present invention. The hood 14 extends away from the face plate 12, but is not necessarily perpendicular to the face plate 12. In this embodiment, the hood 14 is bent away from the face plate 12. This provides a downward angle to the hood 14 away from the face plate 12. A downward angle is effective at shedding snow, rain, ice and dirt that may try to accumulate atop the hood 14.

Figure 6:
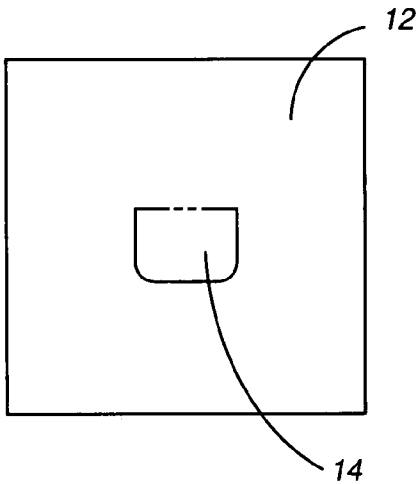
FIG. 6 is a front view of an unpunched hooded aperture for the display and messaging sign, according to the present invention.

FIG. 6 is a front view of an unpunched hooded aperture for the display and messaging sign, according to the present invention. The face plate 12 and hoods 14 are formed from a single sheet of material. No additional material is needed and none is removed. This simplifies the manufacturing process and keeps costs down.

Figure 7:
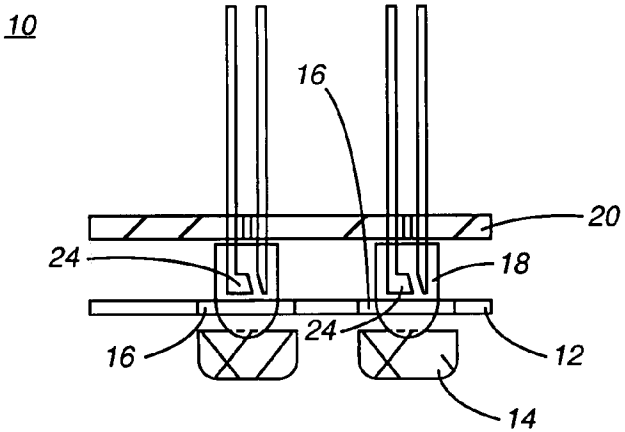
FIG. 7 is a top cutaway view of the display and messaging sign, according to the present invention.

FIG. 7 is a top cutaway view of the display and messaging sign, according to the present invention. The sign 10 includes a circuit board 20 with a plurality of attached LEDs 18. The circuit board 20 may be attached directly to the face plate 12 so the LEDs can easily enter the apertures 16. Light from the LED emanates from a localized source 24, and the LEDs incorporate a lens to focus and direct the light and to protect the light source 24. Contact between the circuit board 20 and the face plate 12 means that light from the LEDs 18 is easily seen over a broad area in front of the sign 10. Thus, messages may be read from a large number of vantage points in front of the sign 10. FIG. 7 shows that light emanating from the LED 18 radiates out to either side of the LED 18, limited only by the aperture 16 and the positioning of the LED 18 in the aperture 16.

Figure 8:
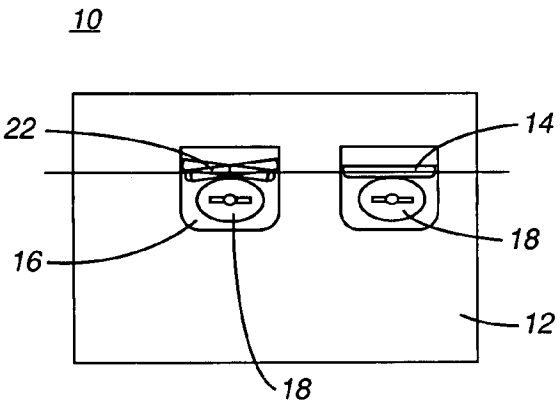
FIG. 8 is a front view of the display and messaging sign, according to the present invention.

FIG. 8 is a front view of the display and messaging sign, according to the present invention. The LEDs may be of any desired shape, but FIG. 8 shows elliptical LEDs 18 centered in the aperture 16. On the right, hood 14 is generally flat and straight across its upper surface. On the left, the hood 22 is curved or angled downward towards the sides of the LED 18. This creates a little peaked roof over the LED 18. The hood 14 may be angled down, at ninety degrees or up from the surface of the face place 12. The hoods are designed for the particular application to provide the greatest shading from direct sunlight while still be viewable from all necessary angles. The angles shown in FIG. 8 represent the angle of shading from the sun, which may be adjusted for the particular application.

Display and messaging signs are typically oriented to maximize their visibility along the most common routes, such as roads. Further, the signs are oriented with their faces vertical. It is not common, nor is it appropriate to place a sign below the field of view. Such an orientation would be hard to see, or ignored, by passersby. Reorienting the signs to point up toward the audience would simply encourage precipitation and dirt to accumulate on the face plate 12, LEDs 18 and in the apertures 16. The curved hood 22 or a peaked hood is very good at shedding precipitation and dirt.

Figure 9:
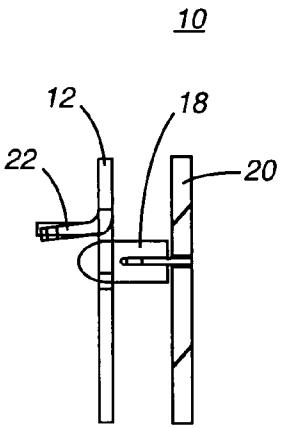
FIG. 9 is a side view of the display and messaging sign, according to the present invention.

FIG. 9 is a side view of the display and messaging sign 10, with the curved hood 22. The curved hood 22 must necessarily affect the visibility of the LEDs 18 from certain positions. For the curved hood 22, the outer edges of the curved hood 22 would be more restrictive than the more upright center portion. The angles shown in FIG. 9 represent the angle of shading from the sun, which may be adjusted for the particular application.

Figure 10:
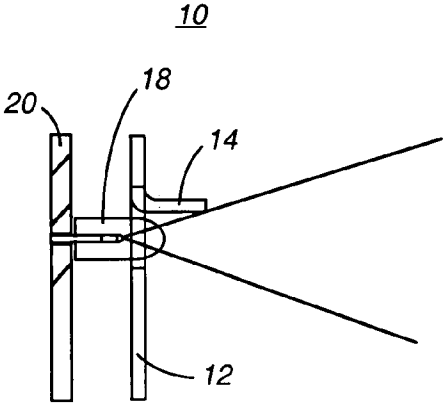
FIG. 10 is a side view of the display and messaging sign, according to the present invention.

FIG. 10 is a side view of the display and messaging sign 10, with the flat hood 14. The flat hood 14 must necessarily affect the visibility of the LEDs 18 from certain positions, but not to the degree of the curved hood 22. For the flat hood 14, the outer edges and the center section are equally restrictive. The angles shown in FIG. 10 represent the angle of illumination by the LED, which may be adjusted for the particular application.

Thus there has been described a hooded face plate that is inexpensive to manufacture and provides significant contrast enhancement of the pixels in direct sunlight.

While the invention has been described with preferred specific embodiments thereof, it will be understood that this description is intended to illustrate and not to limit the scope of the invention, which is defined by the following claims.

I claim:

1. A method of making a display and messaging sign comprising the steps of:

providing a plurality of pixels;

providing at least one light source for each of the plurality of pixels;

punching a plurality of hoods from a face plate to form an integral hooded face wherein each said light source is positioned in said each hood and wherein the face plate is a single sheet of material and no material is added or removed to form the plurality of hoods; and assembling the plurality pixels, the at least light source and the integral hooded face plate to form the display and messaging sign.

2. The display and messaging sign of claim 1, where the hooded face plate is mounted to a circuit board.

3. The display and messaging sign of claim 1, where the plurality of pixels enter each of the apertures and are even with an outer surface of the face plate.

4. The display and messaging sign of claim 1, where the plurality of pixels enter each of the apertures and extend beyond an outer surface of the face plate.

5. The display and messaging sign of claim 1, where the plurality of pixels are light emitting diodes.

6. The display and messaging sign of claim 1, wherein the hood is angled up from a face of the integral face plate.

7. The display and messaging sign of claim 1, wherein the hood is angled down from a face of the integral face plate.

8. The display and messaging sign of claim 1, wherein the hood is angled ninety degrees from a face of the integral face plate.

9. The display and messaging sign of claim 1, wherein the hood is formed in the face plate.

10. The display and messaging sign of claim 9, wherein the hood is punched into the face plate.

11. The display and messaging sign of claim 1, wherein the hood has a curved top.

12. A method of making a display and messaging sign comprising the steps of:

providing a plurality of pixels;

providing at least one light source for each of the plurality of pixels;

punching a plurality of louvers out of a single sheet of material to form a louvered panel and no material is added or removed from said single sheet to form said louvers; wherein each said light source is positioned in each louvre; and assembling the plurality of pixels, the at least one light source and the louvered panel into the display and messaging sign.

13. The display and messaging sign of claim 12, where each of the plurality of pixels are about even with an outer surface of the louvered panel.

14. The display and messaging sign of claim 12, where each of the plurality of pixels extends beyond an outer surface of the louvered panel.

15. The display and messaging sign of claim 12, where the louver is curved over its light emitting element.

16. The display and messaging sign of claim 12, wherein the louver is angled up from a face of the integral face plate.

17. The display and messaging sign of claim 12, wherein the louver is angled down from a face of the integral face plate.

18. The display and messaging sign of claim 12, wherein the louver is angled ninety degrees from a face of the integral face plate.

* * * * *